United States Patent [19]

Blum et al.

[11] 4,031,995

[45] June 28, 1977

[54] KEYBOARD ACTUATED PAPER INSERTION AND EJECTION MECHANISM

[75] Inventors: Rudolf Blum, Nurnberg; Bernd Stiller, Berlin, both of Germany

[73] Assignee: Triumph Werke Nurnberg A.G., Nurnberg, Germany

[22] Filed: Mar. 17, 1976

[21] Appl. No.: 667,554

[30] Foreign Application Priority Data

June 13, 1975 Germany ..... 2526445

[52] U.S. Cl. ..... 197/138 A; 197/127 R

[51] Int. Cl.[2] ..... B41J 13/20

[58] Field of Search ..... 197/127 R, 133 R, 138 A, 197/138 R; 271/3, 272–274

[56] References Cited

UNITED STATES PATENTS

| | | | |
|---|---|---|---|
| 2,204,243 | 6/1940 | Anderson | 197/127 R |
| 2,210,168 | 8/1940 | Hart | 197/138 A |
| 2,353,407 | 7/1944 | Kurowski | 197/127 R |
| 3,276,562 | 10/1966 | Mathews | 197/127 R |
| 3,292,762 | 12/1966 | Erickson | 197/138 R |
| 3,960,258 | 6/1976 | Aebi | 197/127 R |

*Primary Examiner*—Russell R. Kinsey
*Assistant Examiner*—Paul J. Hirsch
*Attorney, Agent, or Firm*—Joseph R. Spalla

[57] ABSTRACT

A typewriter mechanism responsive to an operator-controlled key automatically inserts a sheet of paper between the platen and paper bail in preparation for printing by raising the bail as the platen-entrained paper advances with the platen and then restoring the bail when the paper has passed between the platen and the bail.

4 Claims, 4 Drawing Figures

KEYBOARD ACTUATED PAPER INSERTION AND EJECTION MECHANISM

BACKGROUND

This invention relates to an automatic, keyboard-operated paper insertion and ejection mechanism for typewriters, calculators or similar office machines. While the invention is described and claimed in connection with a typewriter, the invention is equally applicable for use in calculators or similar office machines.

Modern office machines perform various machine functions by automatic, keyboard-controlled mechanisms which were previously performed by manually operated mechanisms. It has been found that many of the manually operated mechanisms cannot be adapted to keyboard-controlled operation, but must be replaced by specially suited automatic mechanisms. Two such functions are the paper insertion function and the paper ejection function.

To automatically feed the paper to printing position in response to a keyboard-mounted switch, the machine mechanism must lift the paper bail, which is normally biased into engagement with the platen, off the platen so that the paper may be readily inserted between the platen and the bail-mounted pressure rolls as the platen-entrained paper advances with the platen. To complete insertion of the paper, the paper bail must be restored to apply pressure to the platen-entrained paper. Similarly, in response to a keyboard switch-actuated signal, the mechanism must also lift the paper bail to eject and allow withdrawal of the paper from between the bail and platen when printing has been completed. This requires a precision connection between the paper feed and the lifting mechanism, which is most conveniently achieved by a geared connection with the platen. However, the lifting and restoring mechanism must be disengaged from the paper feed mechanism during the line-indexing operation.

SUMMARY OF THE INVENTION

Briefly, the invention of an automatic, keyboard-controlled paper insertion mechanism for typewriters, calculators or similar machines, inserts the paper between the platen and the paper bail in preparation for printing.

The mechanism includes a counter gear wheel meshing with the teeth of a gear wheel fixed to the platen, a one-cycle clutch for selectively entraining a camming pin for rotation with the counter gear wheel, a control lever guidedly mounted in the typewriter and having a camming surface for cooperation with the camming pin, a link connecting the control lever with the paper bail, and an electromagnet connected to a detent lever for selective engagment of the clutch. The clutch includes a clutch wheel fixed to the counter gear wheel and an entrainer disc mounted concentrically with the counter gear wheel. A clutch pawl is pivotally mounted on the entrainer disc, is constantly urged into engagement with the clutch wheel by a spring mounted on the entrainer disc, and is retained disengaged from the clutch wheel by a detent surface formed on the clutch pawl which cooperates with the detent surface of the detent lever.

On command from a keyboard mounted switch starting the paper insertion program, rotation of the platen and the meshing counter gear wheel is initiated, and the electromagnet is energized, releasing the pawl to engage the clutch wheel and entraining the entrainer disc for rotation with the counter gear wheel. As the counter gear wheel and platen rotate through a given angular distance, the entrainer disc carries the camming pin into engagement with the camming surface on the control lever to pivot the link and paper bail away from the platen and allow the paper to be inserted between the platen and the bail. As the platen and counter gear wheel continue to rotate, the camming pin acts against another camming surface associated with the control lever to pivot the link to restore the paper bail to the platen. With continued rotation of the platen and counter gear wheel, the detent surface of the pawl encounters the detent surface of the detent lever, disengaging the entrainer disc from the counter gear wheel at the end of a revolution of the entrainer disc. The platen continues to be indexed by the stepping motor to move paper to a desired printing line. Since the insertion mechanism is disengaged from the platen driver gear wheel, subsequent line indexing may take place without disturbing the engagement between the paper and the platen.

Additionally, the mechanism may be used to eject and allow withdrawal of paper from between the platen and the bail after printing has been completed.

OBJECTS OF THE INVENTION

An object of the invention is to insert paper into printing position between the platen and paper bail of a typewriter by an automatic keyboard-controlled mechanism.

Another object of the invention is to insert paper into printing position between the platen and paper bail of a typewriter by an automatic keyboard-controlled mechanism which lifts the bail off the platen to allow the paper to pass between the platen and the bail-mounted pressure rolls and which restores the paper bail to the platen to hold down the platen-entrained paper.

Yet another object of the invention is to insert paper into printing position between the platen and paper bail of a typewriter by an automatic keyboard-controlled mechanism which is disengaged during line indexing operation of the typewriter.

Another object and allow withdrawal of of the invention is to eject paper from between the paper bail and the platen of a typewriter by an automatic, keyboard-controlled mechanism.

Yet another object of the invention is to provide an automatic, keyboard-controlled mechanism which inserts paper to printing position between the platen and paper bail of a typewriter and additionally ejects the paper from between the platen and paper bail.

Other objects and many of the attendant advantages of the present invention will become apparent to those skilled in the art from a reading of the following detailed description taken in conjunction with the accompanying drawing wherein like reference characters designate like parts and wherein:

DETAILED DESCRIPTION OF THE INVENTION

Figure 1:
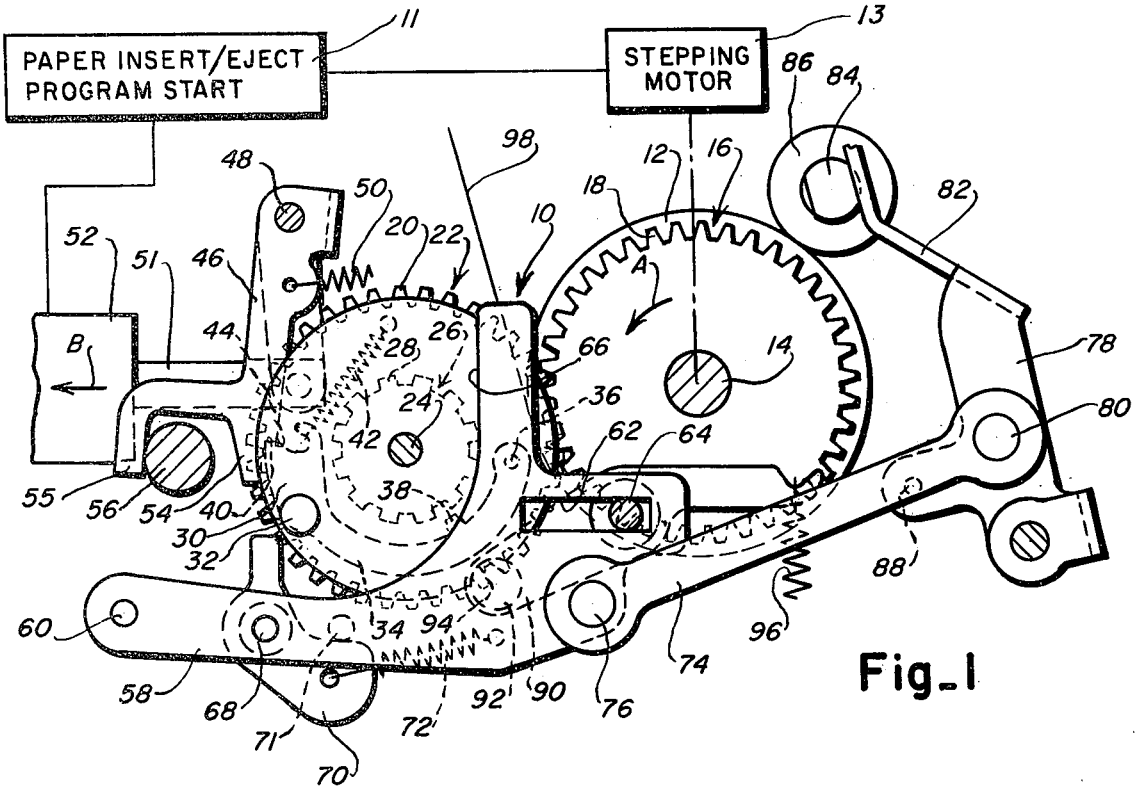
FIG. 1 is a side view of the keyboard-controlled feed, insertion and ejection mechanism of the invention in rest position, ready for receiving a sheet of paper.
Figure 2:
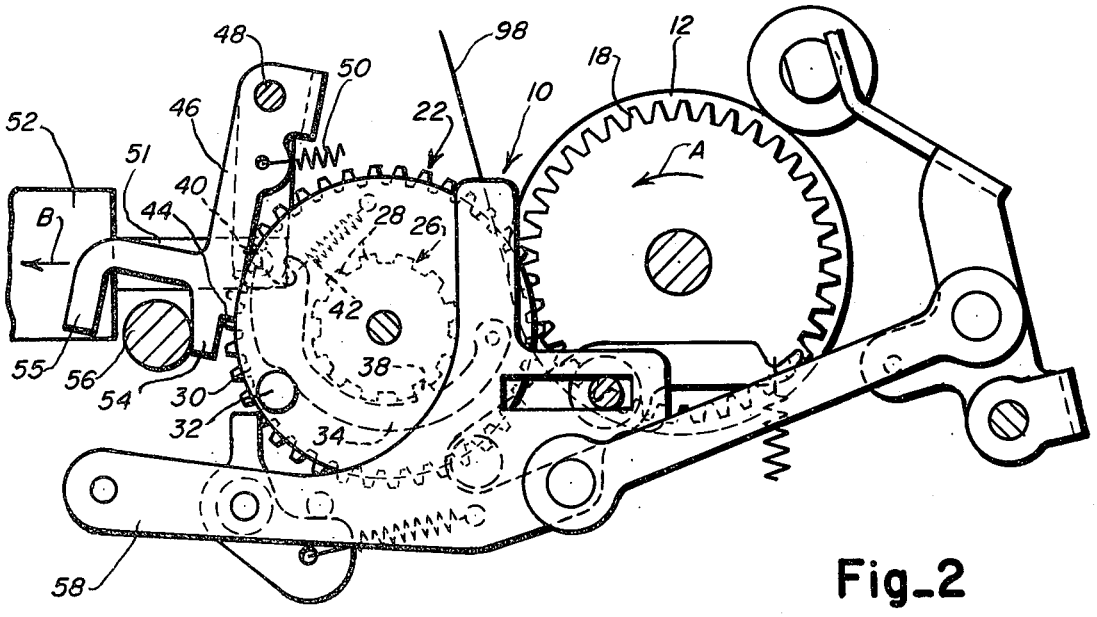
FIG. 2 is a side view of the keyboard operated feed, insertion and ejection mechanism of the invention immediately after the operator has pressed the paper insertion key.

Referring to FIG. 1, the paper insertion and ejection mechanism of the invention, generally indicated by reference numeral 10 includes a paper insertion and ejection program start means 11 which comprises a keyboard mounted operator controlled key which controls the operation of an electromagnet 52 and a stepping motor 13 mechanically connected with a shaft 14 by conventional means not shown. A platen 12 is secured to shaft 14 which is mounted for rotational movement on the side frames (not shown) of the typewriter. Rigidly fixed to platen 12 is a gear wheel 16 having teeth 18 which continuously mesh with cooperating gear teeth 20 on counter gear wheel 22 mounted for rotational movement about a stud 24 mounted on the side frame of the typewriter. A clutch wheel 26 having teeth 28 is fixed to counter gear wheel 22 and is mounted for rotation about stud 24 with the counter gear wheel. An entrainer disc 30 mounted for free rotation about stud 24 mounts a fixed projecting camming pin 32 on one side and a clutch pawl 34 on the opposite side, pawl 34 being freely pivotable about a fixed pivot 36.

Clutch pawl 34 is provided with an inwardly projecting tooth 38 and a detent surface 40 and is continuously urged inwardly under the force of spring 42 connected with the clutch pawl and mounted on entrainer disc 30.

In the rest position illustrated in FIG. 1, detent surface 40 of clutch pawl 34 cooperates with a mating detent surface 44 on a detent lever 46 which is pivotally mounted on a side frame fixed pivot 48. Detent lever 46 is spring-loaded toward clutch pawl 34 by side frame mounting spring 50, is pivotally secured to the actuating arm 51 of electromagnet 52, and is provided with inner and outer limit legs 54, 55 which cooperate with a side frame fixed stop 56 to limit the displacement of detent surface 44 of the detent lever.

A control lever 58 has a guide pin 60 and guide slot 62 which cooperate with a side frame fixed guide slot (not shown) and side frame fixed guide pin 64, respectively, to allow control lever 58 to translate horizontally in the machine frame, as shown in FIGS. 1–4. Control lever 58 is provided with an inwardly projecting camming surface 66 for cooperation with camming pin 32 of entrainer disc 30, as explained hereinafter, and is provided with a pivot 68 pivotally mounting a release pawl 70, which is constantly urged against a control lever fixed pin 71 by release spring 72 fixed to control lever 58. A connecting link 74 is pivotally connected with control lever 58 at pivot 76 and with a paper bail 78 at pivot 80. Paper bail 78 has bail arms 82 fixed to a bar 84 mounting a pressure roll or rolls 86 and is biased either toward platen 12 or away from the platen under the force of an over-center spring (not shown), as is known in the art, attached to bail 78 at opening 88.

Mounted for pivotal movement on side frame fixed guide pin 64 is a detent lever 90 having a projecting detent 92 for cooperation with a detent recess 94 (FIGS. 3 and 4) formed in entrainer disc 30. Detent lever 90 is urged inwardly toward entrainer disc 30 under the force of a side frame fixed spring 96.

In operation, the mechanism 10 of the invention is initially in the rest position shown in FIG. 1. The typewriter operator positions a piece of paper 98 into the nip between platen 12 and feed rollers (not shown) as is conventional in the art and which forms no part of the invention. The operator then actuates the paper insertion program start means 11 by pressing an "insert" key located on the typewriter keyboard, generating a signal which starts stepping motor 13 connected with shaft 14 of platen 12 for programmed rotation of the platen in the direction of arrow A of FIG. 1 and which simultaneously energizes electromagnet 52 drawing electromagnet armature 51 inwardly, or in the direction of arrow B of FIG. 1.

As platen 12 rotates in the direction of arrow A, feeding paper 94 around the platen, platen gear teeth 18 rotate counter gear wheel teeth 20 and counter gear wheel 22 in the opposite direction. The paper is guided around the platen by feed rollers and a paper tray (not shown) as is conventional in the art and which form no part of the invention. As armature 51 of electromagnet 52 is drawn inwardly to the position shown in FIG. 2, detent lever 46 pivots about pivot 48 in the direction of arrow B until inner limit leg 54 of the detent lever is blocked by stop 56, releasing detent surface 40 of clutch pawl 34 from detent surface 44 of detent lever 46. After being released, clutch pawl 34 is drawn inwardly under the force of spring 42 and clutch pawl tooth 38 engages the appropriate tooth of teeth 28 of clutch wheel 26, rotating with counter gear wheel 22, thus entraining entrainer disc 30 to rotate with counter gear wheel 22. Detent lever 46 is urged inwardly against the outer surface of clutch pawl 34 by spring 50 and when the clutch pawl has rotated a sufficient distance, detent lever 46 is restored to the position of FIG. 1 with the outer limit leg 55 of the detent lever retained against stop 56.

Figure 3:
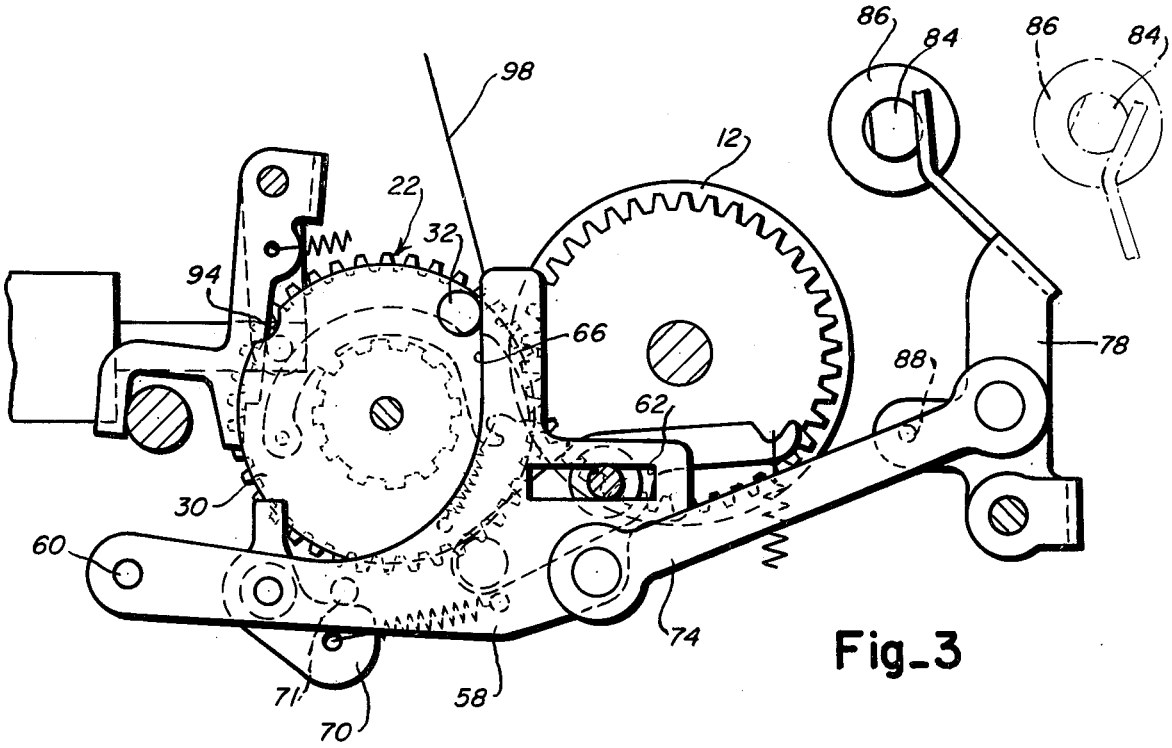
FIG. 3 is a view similar to the views of FIGS. 1 and 2 showing the mechanism of the invention lifting the paper bail off the platen.
Figure 4:
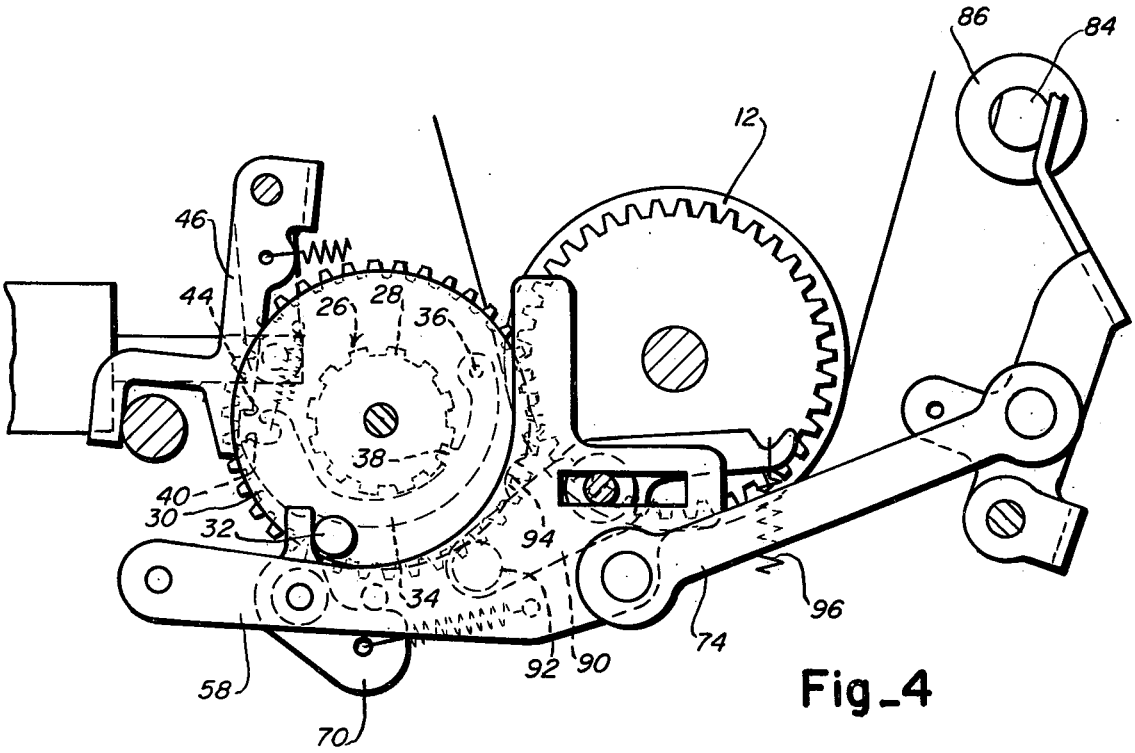
FIG. 4 is a view similar to the views of FIGS. 1–3 showing the mechanism of the invention restoring the paper bail toward the platen, the paper having been fed to printing position, shortly before the end of the cycle of the mechanism.

As platen 12 and counter gear wheel 22 rotate and feed platen entrained paper 98 in preparation for insertion between the platen and pressure rolls 86, entrainer disc 30 rotates and carries camming pin 32 into contact with camming surface 66 on control lever 58, as shown in FIG. 3. Continued rotation of platen 12, counter gear wheel 22, and entrainer disc 30 carrying pin 32 translates control lever 58, guided by pin 60 and slot 62, toward paper bail 78, driving connecting link 74 to pivot paper bail 78 away from the platen against the force of the over-center spring connected to the bail at opening 88, lifting pressure rolls 86 from platen 12. Continued rotation of entrainer disc 30 pivots bail 78 and opening 88 to drive the over-center spring over-center, retaining bail 78 in the open position shown in phantom in FIG. 3. Continued rotation of entrainer disc 30 brings camming pin 32 into contact with release pawl 70, pushing the release pawl, which is locked in position by pin 71, away from the platen, carrying control lever 58 and connecting link 74, and pivoting paper bail 78 toward the platen, as shown in FIG. 4. Pressure rolls 86 are thus lifted off platen 12 during a predetermined portion of the angular path of the platen, allowing the paper to be inserted between the pressure rolls and the platen, and are returned to the platen to hold the inserted paper in position in preparation for printing.

As entrainer disc 30 continues to rotate, camming pin 32 drives the release pawl 70 and control lever 58 away from paper bail 78, connecting link 74 pivots the paper bail toward the platen until the over-center spring retained in opening 88 is driven back over-center, urging the paper bail, bar 84, and pressure rolls to frictionally engage paper 98 against platen 12. Continuing rotation of clutch wheel 26 and entrainer disc 30 brings detent surface 40 of clutch pawl 34 into contact with mating detent surface 44 of restored detent lever 46, and continued rotation of clutch wheel 26 pivots the clutch pawl outwardly about pivot 36, disengaging clutch pawl tooth 38 from teeth 28 of clutch wheel 26, and ending rotation of entrainer disc 30. Detent 92 of inwardly urged detent lever 90 cooperates with detent recess 94 (FIGS. 3 and 4) in entrainer disc 30 to insure that the entrainer disc comes to rest in predetermined angular position at the end of each insertion cycle.

Stepping motor 13 continues rotating platen 12 and counter gear wheel 22 an incremental distance, insuring that the counter gear wheel is disengaged from the clutch pawl, and the stepping motor is then deactivated, terminating the paper insertion program with the paper insertion mechanism returned to the rest position shown in FIG. 1 and the paper inserted between the platen and the paper bail, and line indexed in printing postion. Typing may now begin and keyboard-controlled line indexing may now take place without disturbing the engagement between the paper bail and the platen-entrained paper sheet.

To eject paper 98 from between the platen and the paper bail, the identical mechanism operation sequence is followed, with the typewriter operator initiating the paper ejection program by pushing the keyboard mounted "insert" key and then removing the paper when it is released from the platen and associated rollers and when the mechanism of the invention lifts the paper bail and pressure rolls away from the platen.

The invention claimed is:

1. In a typewriter having a rotatable platen and an associated paper hold down bail pivotally mounted for movement between a closed position in rolling contact with said platen and to an open position spaced from said platen, energizable motor means connected to rotatably index said platen to control movement of a sheet of paper, a first clutch part rotatably driven by said platen, a second rotatable clutch part selectively engageable with and driven by said first clutch part and having a camming pin, a solenoid, means for coupling over a platen revolution said first and second clutch parts upon energization of said solenoid, a control lever connected to said paper bail and positioned to be driven by said camming pin to pivot said paper bail to open and closed positions in each clutch cycle, and operator controlled means for energizing said motor means and for energizing said solenoid.

2. In a typewriter as recited in claim 1, said coupling means including a pawl pivotally mounted on said second clutch part and normally biased to engage said first clutch part thereby to couple said first and second clutch parts, said solenoid having an armature normally positioned to maintain said pawl disengaged and to release said pawl when said solenoid is energized.

3. In a typewriter as recited in claim 2, said control lever being mounted for translating movement and having first and second camming surfaces located in the path of and operative by said camming pin, to move said control lever in bail opening direction and bail closing direction in each revolution of said clutch.

4. In a typewriter as recited in claim 3, said motor means comprising a stepping motor and wherein said stepping motor and solenoid are simultaneously energized by said keyboard mounted means, said solenoid being energized momentarily and said stepping motor being energized over a predetermined programmed interval.

* * * * *

UNITED STATES PATENT AND TRADEMARK OFFICE

CERTIFICATE OF CORRECTION

PATENT NO. : 4,031,995

DATED : June 28, 1977

INVENTOR(S) : Rudolf Blum and Bernd Stiller

It is certified that error appears in the above-identified patent and that said Letters Patent are hereby corrected as shown below:

In The Specification:

Column 2, line 44, after "object" cancel "and allow withdrawal of";
line 45, after "eject" insert --and allow withdrawal of--.

Column 3, line 42, cancel "mounting" and insert --mounted--.

Column 5, line 28, cancel "postion" and insert --position--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*